US011017625B2

(12) United States Patent
Ou et al.

(10) Patent No.: US 11,017,625 B2
(45) Date of Patent: May 25, 2021

(54) SMART KEY BOX

(71) Applicant: Lubn Inc., Bellevue, WA (US)

(72) Inventors: Shih-Hsun Ou, Bellevue, WA (US); Chiu-Wan Li, Bellevue, WA (US); Yuan-Chou Chung, Bellevue, WA (US)

(73) Assignee: LUBN INC., Bellevue, WA (US)

( * ) Notice: Subject to any disclaimer, the term of this patent is extended or adjusted under 35 U.S.C. 154(b) by 0 days.

(21) Appl. No.: 16/911,107

(22) Filed: Jun. 24, 2020

(65) Prior Publication Data

US 2020/0410807 A1 Dec. 31, 2020

Related U.S. Application Data

(60) Provisional application No. 62/866,801, filed on Jun. 26, 2019.

(51) Int. Cl.
*G07F 17/12* (2006.01)
*G07C 9/00* (2020.01)

(52) U.S. Cl.
CPC ..... *G07F 17/12* (2013.01); *G07C 9/00309* (2013.01); *G07C 9/00944* (2013.01); *G07C 2009/0096* (2013.01); *G07C 2009/00388* (2013.01); *G07C 2009/00952* (2013.01)

(58) Field of Classification Search
CPC ..... G07F 17/12; G07C 9/00309; G07C 2009/00952; G07C 9/00944; G07C 2009/0096; G07C 2009/00388; G07C 2009/00785; G07C 9/00182; G07C 2009/0065; G07C 2009/00936; G07C 9/00896
USPC ..... 340/5.73, 5.6; 70/63
See application file for complete search history.

(56) References Cited

U.S. PATENT DOCUMENTS 4,609,780 A * 9/1986 Clark ..... E05B 19/0005 379/102.06
4,718,259 A * 1/1988 Appelbaum ..... E05B 19/0005 109/52
4,869,082 A * 9/1989 Appelbaum ..... E05B 19/0005 70/63
5,280,518 A * 1/1994 Danler ..... G07C 9/00857 379/102.06
6,526,786 B1 * 3/2003 Kayoda ..... E05B 19/0005 70/14

(Continued)

*Primary Examiner* — Nam V Nguyen
(74) *Attorney, Agent, or Firm* — Muncy, Geissler, Olds & Lowe, P.C.

(57) ABSTRACT

A smart key box includes a key holding element, a housing, a power assembly, sensing units, an authentication module, and a control module. The housing is configured to contain the key holding element. The power assembly is disposed in the housing and configured to drive the key holding element to leave the housing or enter the housing along an access direction. The sensing units are disposed in the housing. When the key holding element leaves the housing or enters the housing, the key holding element is configured to trigger at least one of the sensing units. The authentication module is disposed at the housing. The control module is disposed in the housing and electrically connected with the power assembly, the sensing units, and the authentication module, and is configured to control the power assembly according to the at least one of the sensing units which is triggered.

15 Claims, 18 Drawing Sheets

(56) References Cited

U.S. PATENT DOCUMENTS

| | | | | |
|---|---|---|---|---|
| 6,727,801 | B1 * | 4/2004 | Gervasi | E05B 19/0005 340/5.3 |
| 7,340,400 | B2 * | 3/2008 | McGinn | G06Q 10/087 340/5.8 |
| 8,138,886 | B1 * | 3/2012 | Chang | G07C 9/00817 340/5.73 |
| 8,307,677 | B2 * | 11/2012 | Larson | A45C 11/325 70/456 R |
| 8,695,385 | B2 * | 4/2014 | Meekma | E05B 37/02 70/63 |
| 8,966,946 | B2 * | 3/2015 | Lai | E05B 37/025 70/63 |
| 9,540,845 | B1 * | 1/2017 | Yang | E05B 19/0005 |
| 9,670,694 | B2 * | 6/2017 | Larson | E05B 19/0005 |
| 9,771,737 | B1 * | 9/2017 | Rais | E05B 19/0005 |
| 10,089,806 | B2 * | 10/2018 | Chung | G07C 9/00896 |
| 2009/0167526 | A1 * | 7/2009 | Graves | G07C 9/00309 340/540 |

* cited by examiner

SMART KEY BOX

RELATED APPLICATION

This application claims priority to U.S. Provisional Application Ser. No. 62/866,801, filed Jun. 26, 2019, which is herein incorporated by reference in its entirety.

BACKGROUND

Field of Invention

The embodiments of the present disclosure relate to a key box, and more particularly, to a smart key box.

Description of Related Art

In the property management field, an agent may be responsible for the rental and sale of multiple properties. When a client wants to see a house, the agent needs to go to the site to hand over a key of the house to the client, and wait to take the key back until the client finishes viewing the house. In this case, if there are multiple clients making appointments to view the house, the agent will be very busy. In addition, if there are multiple clients making appointments to view different houses at the same time, the agent may only make a trade-off and thus sometimes loses some clients.

Therefore, there is a need to provide a smart key box that can allow clients to get keys through the smart key box while agents needn't go to the site, thereby improving management efficiency of agents.

SUMMARY

An object of the present disclosure is to provide a smart key box that allows clients to get keys through the smart key box while agents needn't go to the site, thereby improving management efficiency of agents.

According to the object of the present disclosure, a smart key box is provided, and includes a key holding element, a housing, a power assembly, sensing units, an authentication module, and a control module. The key holding element can hold a key. The housing can contain the key holding element. The power assembly is disposed in the housing and can drive the key holding element to leave the housing or enter the housing along an access direction. The sensing units are disposed in the housing. When the key holding element leaves the housing or enters the housing, the key holding element is configured to trigger at least one of the sensing units. The authentication module is disposed at the housing. The control module is disposed in the housing and electrically connected with the power assembly, the sensing units, and the authentication module, and is configured to control the power assembly to operate or not to operate according to the at least one of the sensing units which is triggered.

In some embodiments, the power assembly includes a power wheel.

The power wheel is disposed in the housing and contacts a side of the key holding element.

In some embodiments, the smart key box further includes an auxiliary wheel. The auxiliary wheel is disposed in the housing and contacts another side of the key holding element.

In some embodiments, the power wheel is located between two of the sensing units along the access direction.

In some embodiments, the sensing units are disposed along the access direction.

In some embodiments, the housing has an opening, the key holding element enters or leaves the housing through the opening, and one of the sensing units is disposed on a side of the housing opposite to the opening.

In some embodiments, the sensing units include a mechanical sensing element, an optical sensing element, a capacitive sensing element, an inductive sensing element, an electromagnetic sensing element, or any combination thereof.

In some embodiments, the smart key box performs a key obtaining procedure to push outward the key holding element, and the authentication module is configured to obtain authentication information in the key obtaining procedure.

In some embodiments, the smart key box performs a retraction verifying procedure, in which the control module is configured to determine whether the key holding element that has been pushed outward is retracted according to a waiting time.

In some embodiments, the smart key box performs a key returning procedure, and the control module is configured to determine whether the key holding element is returned into the housing according to a key returning trigger configuration of the sensing units.

In some embodiments, the smart key box further includes a locking element. The locking element is disposed on the housing and configured to connect with an object to lock the housing to the object.

In some embodiments, the authentication module is configured to take a picture of a displayed image of a handheld device to obtain authentication information.

In some embodiments, when the control module and/or the authentication module determine that the authentication information is eligible, the control module controls the locking element to be in an unlocked state to disengage the housing from the object.

In some embodiments, the displayed image includes a two-dimensional barcode.

In some embodiments, the key holding element includes a surface and a groove. The surface faces one of the sensing units. The groove is disposed on the surface. When the key holding element leaves or enters the housing, the groove is configured to pass the one of the sensing units such that the surface triggers the one of the sensing units.

In order to make the above features and advantages of the present disclosure more apparent, the following embodiments are described in detail with reference to the accompanying drawings.

BRIEF DESCRIPTION OF THE DRAWINGS

Aspects of the present disclosure are better understood from the following detailed description in conjunction with the accompanying figures. It is noted that in accordance with the standard practice in the industry, various features are not drawn to scale. In fact, the dimensions of the various features can be arbitrarily increased or reduced for clarity of discussion.

DETAILED DESCRIPTION

The embodiments of the present disclosure are discussed in detail below. However, it will be appreciated that the embodiments provide many applicable concepts that can be implemented in various specific contents. The embodiments discussed and disclosed are for illustrative purposes only and are not intended to limit the scope of the present disclosure. In addition, the terms "first", "second", and the like, as used herein, are not intended to mean a sequence or order, and are merely used to distinguish elements or operations described in the same technical terms.

Figure 1:
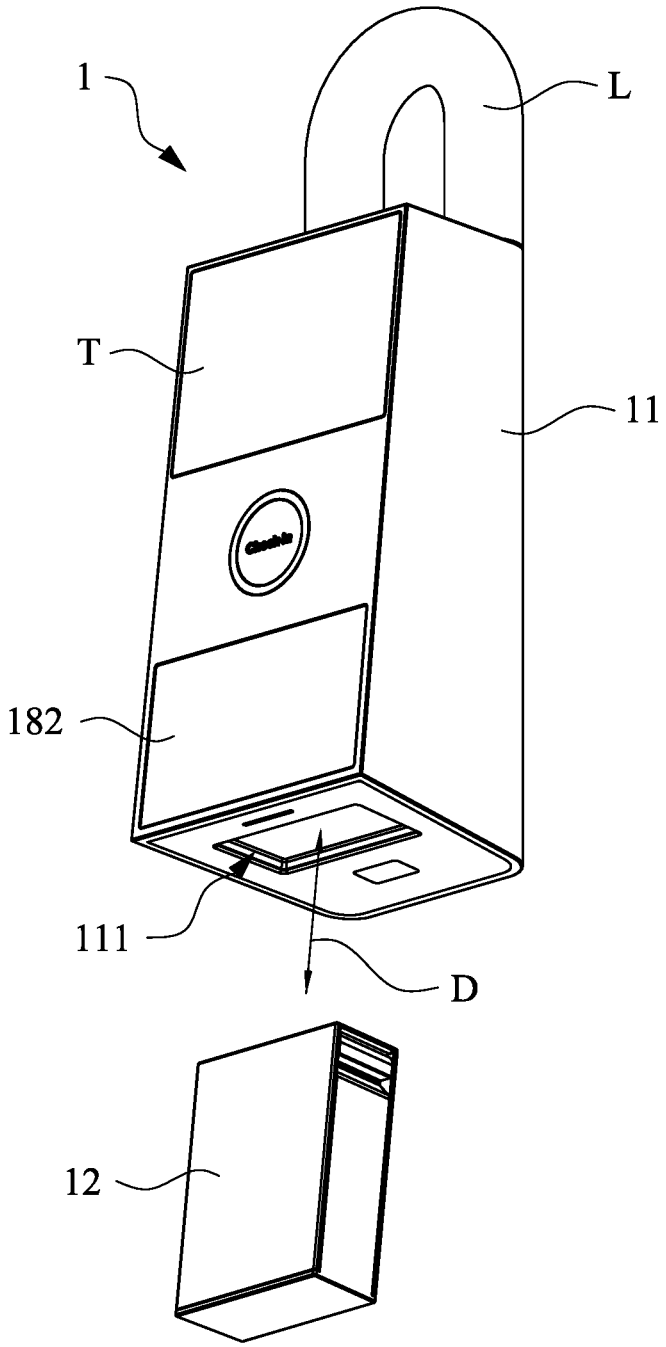
FIG. 1 is a schematic perspective diagram of a smart key box according to embodiments of the present disclosure.

FIG. 1 is a schematic perspective diagram of a smart key box 1 according to embodiments of the present disclosure. As shown in FIG. 1, the smart key box 1 includes a housing 11 and a key holding element 12, wherein the housing 11 can contain the key holding element 12, and a shape of the housing 11 is not limited here, for example, which can be a cuboid. The housing 11 has an opening 111, and the key holding element 12 can leave or enter the housing 11 through the opening 111 along an access direction D. In this embodiment, the housing 11 is further configured with a locking element L, the locking element L is located on a side of the housing 11, a user can fix the smart key box 1 to an object with the locking element L, and the object is, for example, an object outside the house, such as a mailbox, a fence or a corral.

The key holding element 12 can hold a key (not shown). In this embodiment, the key is contained in the key holding element 12, and a user can open the key holding element 12 to get the key. There may be other holding manners in other embodiments, and for example, the key is held on an outer surface of the key holding element 12. Types of the key are also not limited in the present disclosure, which may be, for example, mechanical keys (such as traditional keys) or electronic keys (such as chip cards).

Figure 2:
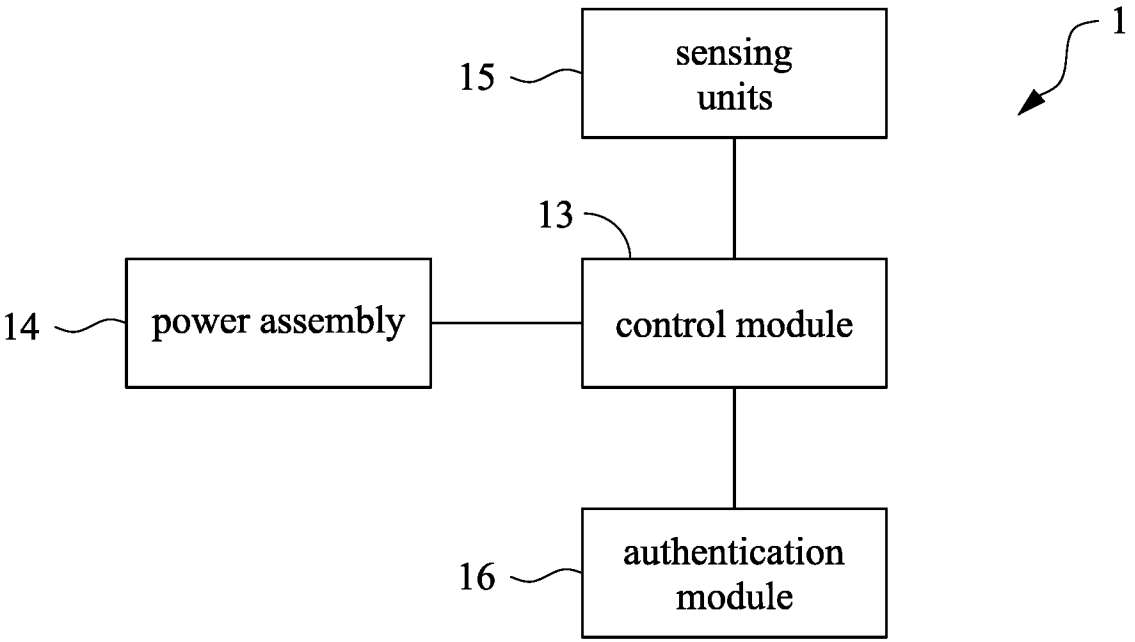
FIG. 2 is a schematic block diagram of a smart key box according to embodiments of the present disclosure.

FIG. 2 is a schematic block diagram of the smart key box 1 according to embodiments of the present disclosure. As shown in FIG. 2, the smart key box 1 includes a control module 13, a power assembly 14, sensing units 15, and an authentication module 16. The control module 13 is electrically connected with the power assembly 14, the sensing units 15, and the authentication module 16.

Please also refer to FIG. 1 for the following description. The control module 13 is disposed in the housing 11. A level of a control function of the control module 13 is not limited in this embodiment, which can be adjusted according to requirements. The control module 13 may, for example, include a central processing unit (CPU) or a micro control unit (MCU), a memory, a program, or other required digital integrated circuits, software, hardware, or firmware to perform required functions.

The power assembly 14 is disposed in the housing 11, and can drive the key holding element 12 to leave or enter the housing 11 along the access direction D. In one embodiment, the power assembly 14 may include an assembly that allows the key holding element 12 to move, which is, for example but not limited to, a motor, a transmission component, a gear component, or a roller.

The sensing units 15 are disposed in the housing 11, and the key holding element 12 triggers the sensing units 15 when leaving or entering the housing 11. In this embodiment, the sensing units 15 are used to detect a movement of the key holding element 12, which may include, for example, mechanical sensing elements, optical sensing elements, capacitive sensing elements, inductive sensing elements, electromagnetic sensing elements, or any combination thereof, to achieve a function of detecting movement, but the present disclosure is not limited thereto. The mechanical sensing element is a spring for example, and a movement of the key holding element 12 can be detected when the spring leaves an original position. The optical sensing element is, for example, a light sensor, an infrared sensor, and a movement of the key holding element 12 can be detected when a light amount is changed. The capacitive sensing element, the inductive sensing element, and the electromagnetic sensing element can detect a movement of the key holding element 12 by using changes in capacitance, inductance, and magnetic field, respectively.

The authentication module 16 is disposed at the housing 11. The authentication module 16 of this embodiment is used for an authentication of a user, and when the authentication is passed, the user can get the key in the key holding element 12. The authentication module 16 may use, for example, light sensing, electric sensing, or image sensing for the authentication. In this embodiment, the authentication module 16 includes an imaging element (not shown), and the imaging element may photograph an image displayed by a cellphone of the user to produce authentication information. The imaging element includes, for example, a charge coupled device (CCD) or a complementary metal-oxide-semiconductor (CMOS). In this embodiment, the imaging element takes a photograph through a transparent member T shown in FIG. 1, and the transparent member T is, for example, glass, and can protect the authentication module 16 and the imaging element. In other embodiments, the transparent member T may be an optical element, such as a lens. After the authentication information is produced, the control module 13 and/or the authentication module 16 can determine whether the authentication information is eligible. Moreover, the imaging element of the authentication module 16 may also be disposed at a suitable position of the housing 11, for example, at a front side of the housing 11, the front side being the side where the transparent member T is located. In one example, the transparent member T may be replaced with a display module, and the imaging element of the authentication module 16 is disposed on one side of the display module.

Figure 3:
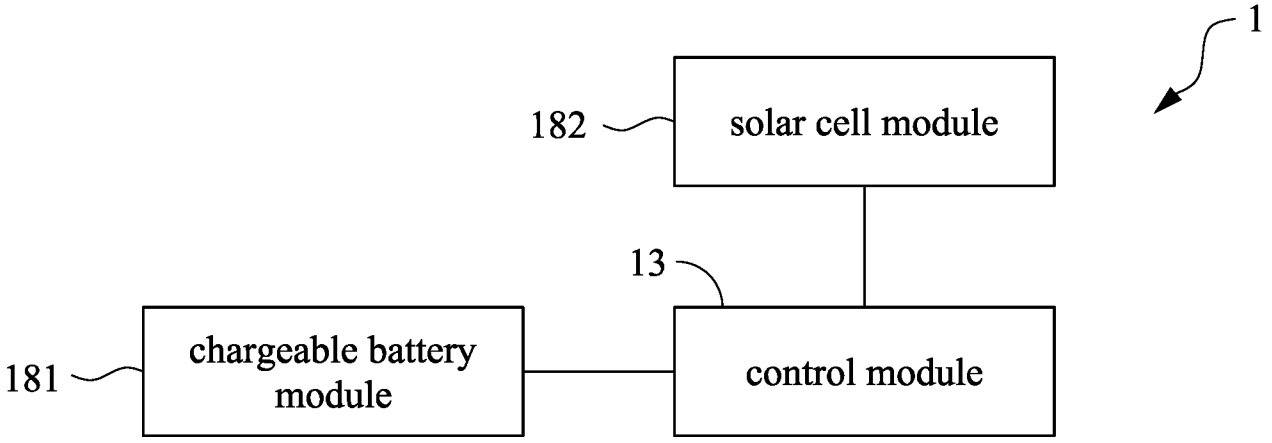
FIG. 3 is a schematic block diagram of a power source portion of a smart key box according to embodiments of the present disclosure.

FIG. 3 is a schematic block diagram of a power source portion of the smart key box 1 according to embodiments of the present disclosure. As shown in FIG. 3, the smart key box 1 may further include a chargeable battery module 181 and a solar cell module 182, and both of the chargeable battery module 181 and the solar cell module 182 are electrically connected with the control module 13. The solar cell module 182 can receive a solar light and convert it into electric energy, so as to charge the chargeable battery module 181. In one embodiment, as shown in FIG. 1, the solar cell module 182 may be disposed at the housing 11. In addition, the solar cell module 182 may be omitted in other embodiments, and chargeable batteries are totally replaced manually. In another embodiment, an electric power source of the smart key box 1 may be mains electricity and/or chargeable batteries.

Figure 4:
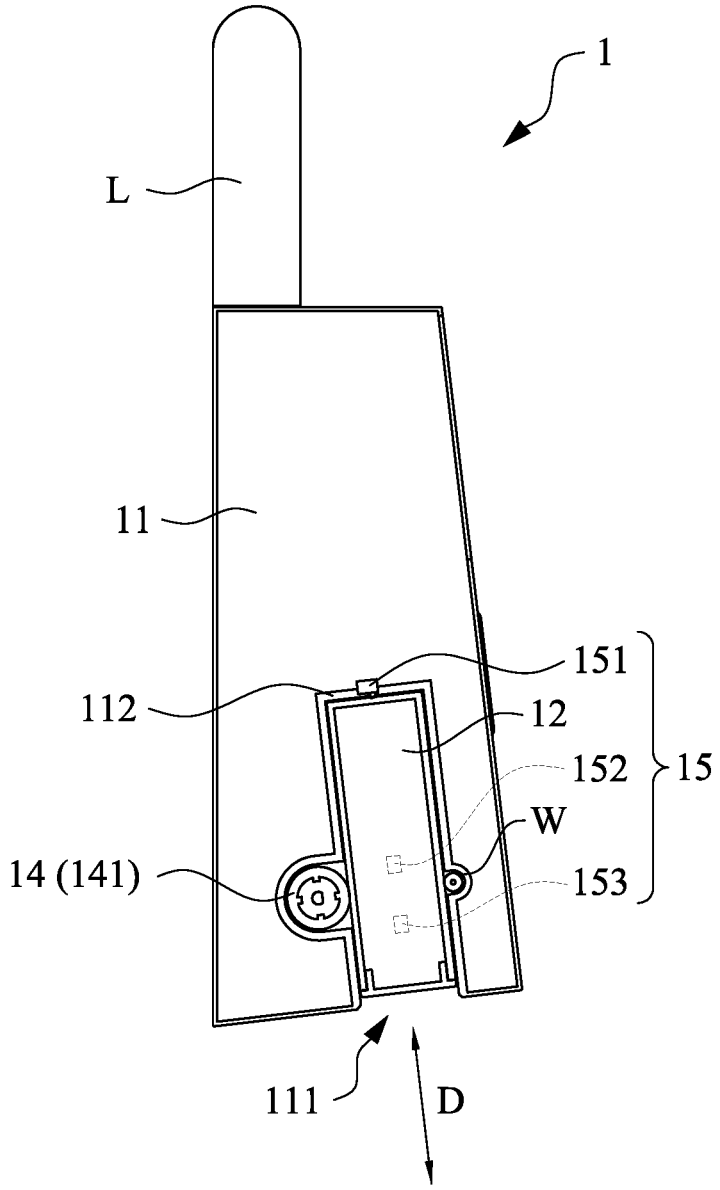
FIG. 4 is a schematic diagram of a configuration of a power assembly and sensing units of a smart key box according to embodiments of the present disclosure.

FIG. 4 is a schematic diagram of a configuration of the power assembly 14 and the sensing units 15 of the smart key box 1 according to embodiments of the present disclosure, in which for convenience of illustration, FIG. 4 also shows the key holding element 12 to indicate a relative relationship between the key holding element 12, the sensing units 15, and the power assembly. As shown in FIG. 4, the power assembly 14 includes a power wheel 141, which contacts a side of the key holding element 12. The power wheel 141 here means it is driven by an electric power to rotate. For example, the power wheel 141 is driven by a driving force of a motor (not shown). In this embodiment, the power wheel 141 can rotate forward or backward. Herein, when the power wheel 141 rotates forward, the key holding element 12 can be driven to leave the housing 11; and when the power wheel 141 rotates backward, the key holding element 12 can be driven to enter the housing 11. Timings of using forward rotation and backward rotation will be further illustrated below.

In addition, the smart key box 1 further includes an auxiliary wheel W, which is disposed in the housing 11 and contacts another side of the key holding element 12. In this embodiment, the auxiliary wheel W means a wheel that is not driven by an electric power. That is, when the key holding element 12 moves, the auxiliary wheel W can be driven to rotate. Herein, the auxiliary wheel W and the power wheel 141 are disposed on two opposite sides of the key holding element 12, respectively, and are disposed opposite to each other. In other embodiments, the auxiliary wheel W and the power wheel 141 may not be disposed opposite to each other.

Herein, there are three sensing units 15 for example, which are sensing units 151, 152, and 153, but this embodiment is not limited thereto, and may have more or less sensing units. The sensing units 15 are fixed in the housing 11 and corresponding to the key holding element 12, such that the key holding element 12 triggers at least one of the sensing units 15 when leaving or entering the housing 11. In this embodiment, the sensing units 151-153 are disposed along the access direction D, but this embodiment is not limited thereto. In other embodiments, the sensing units 151-153 may present a configuration of three points of a triangle. In this embodiment, the sensing unit 151 is the one farthest from the opening 111, the sensing unit 153 is the one closest to the opening 111, and the sensing unit 152 is located between the sensing unit 151 and the sensing unit 153. In addition, in this embodiment, along the access direction D, the power wheel 141 is located between two of the sensing units, and herein the power wheel 141 is located between the sensing unit 152 and the sensing unit 153 as an example for illustration. Furthermore, in this embodiment, one of the sensing units may be disposed on a side 112 of the housing 11 opposite to the opening 111, and the sensing unit 151 is disposed on the side 112 herein.

The smart key box 1 of this embodiment can perform multiple procedures to achieve required functions. Examples are taken below for illustration.

Figure 5:
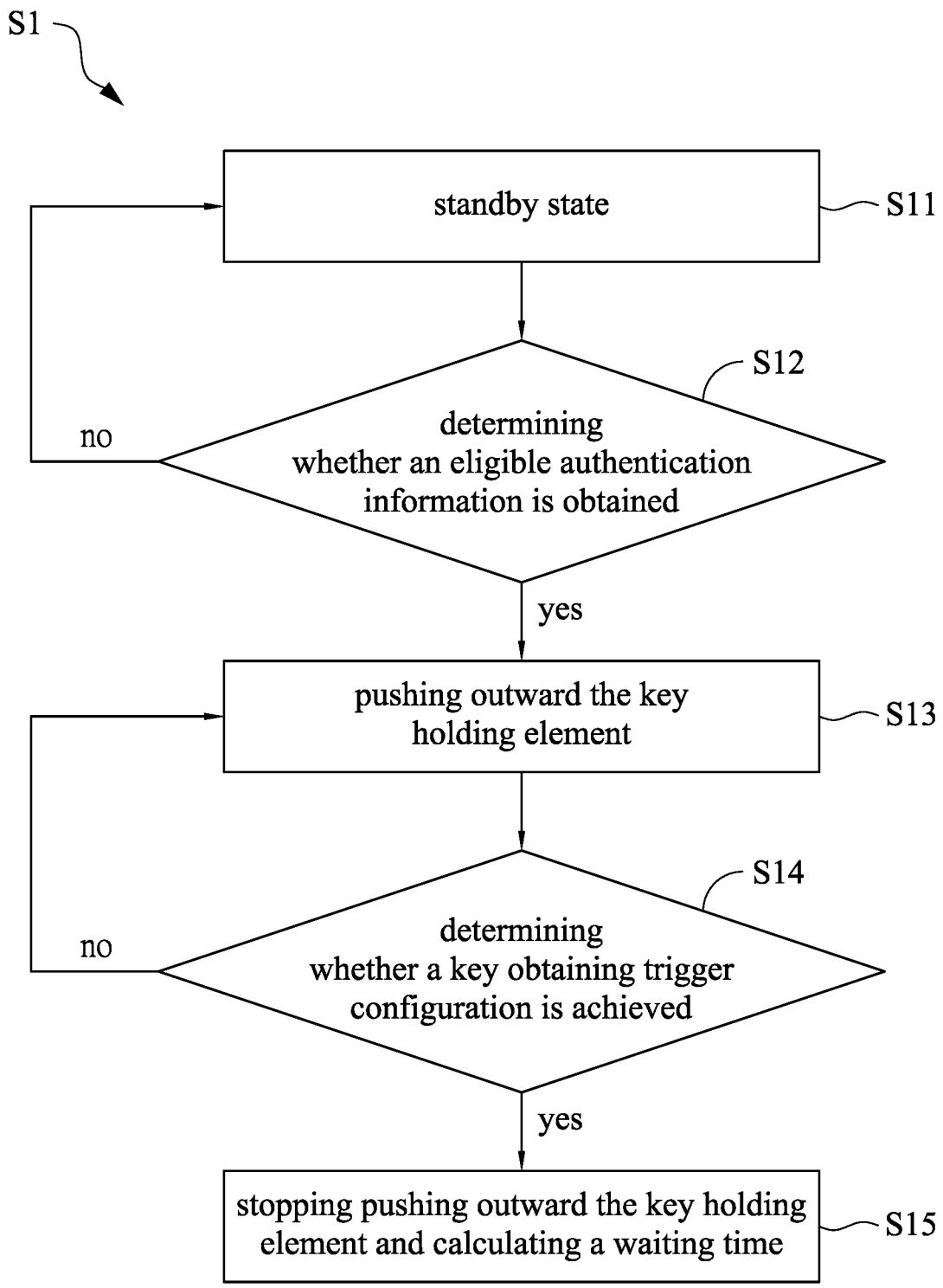
FIG. 5 is a schematic flow chart of a key obtaining procedure performed by a smart key box according to embodiments of the present disclosure.

FIG. 5 is a schematic flow chart of a key obtaining procedure S1 performed by the smart key box 1 according to embodiments of the present disclosure. Referring to FIG. 2, FIG. 4, and FIG. 5, the key obtaining procedure S1 is illustrated below. The smart key box 1 performs the key obtaining procedure S1, such that the key holding element 12 is pushed outward.

As shown in FIG. 5, the key obtaining procedure S1 includes a standby state (S11), determining whether an eligible authentication information is obtained (S12), pushing outward the key holding element 12 (S13) if a result is "yes", going back to the step S11 if the result is "no", determining whether a key obtaining trigger configuration is achieved (S14), stopping pushing outward the key holding element 12 and calculating a waiting time (S15) if a result is "yes", and going back to the step S13 if the result is "no".

Figure 6:
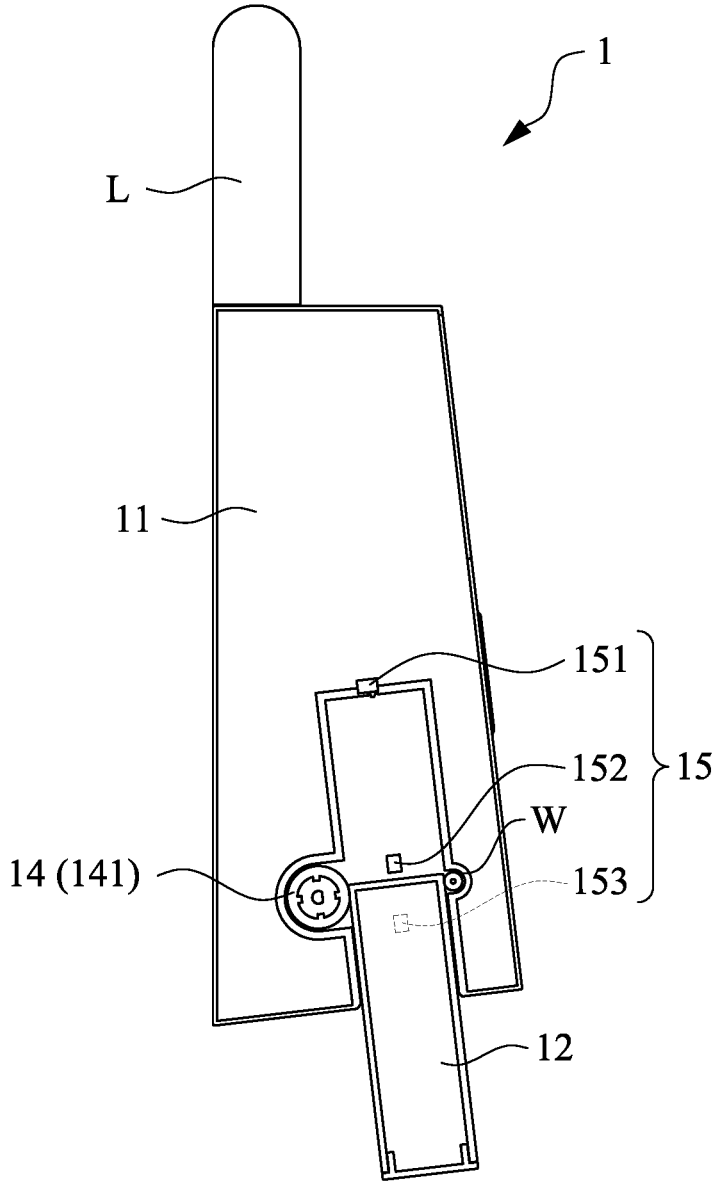
FIG. 6 is a schematic diagram of a state of a smart key box according to embodiments of the present disclosure.

The steps are illustrated below. In the step S11, the authentication module 16 of the smart key box 1 is enabled, that is when a user, for example, puts his cell phone closer to the authentication module 16, the authentication module 16 can immediately photograph an image displayed on a screen of the cell phone and obtain the authentication information. The image displayed on the screen is, for example but not limited to, a two-dimensional barcode. It is noted, the standby state mentioned here is just taken as an example, and the smart key box 1 may be at other operational states according to requirements. In the step S12, determining whether the eligible authentication information is obtained may be performed by the control module 13 and/or the authentication module 16. In the step S13, the control module 13 enables the power assembly 14 to drive the power wheel 141 to rotate, so as to push outward the key holding element 12. During a process of pushing outward the key holding element 12, a state as shown as FIG. 6 is achieved. At this time, the key holding element 12 only triggers the sensing unit 153, but does not trigger the sensing units 151 and 152, and this is the key obtaining trigger configuration defined in this embodiment. Thus, the step S15 is entered. In other embodiments, an opposite setting can be used to regard the state of FIG. 6 as triggering the sensing units 151 and 152 and not triggering the sensing unit 153. In the step S15, the control module 13 controls the power assembly 14 to stop pushing outward the key holding element 12. In this situation, the power wheel 141 stops rotating and clamps the key holding element 12 together with the auxiliary wheel W. In other embodiments, a structural manner may be used to further provide a clamping force. For example, a side of the key holding element 12 is configured with a spring or a bump to provide a clamping force for the key holding element 12. In addition, in the step S15, the control module 13 starts to calculate a waiting time. It is noted, the waiting time is for a following retraction verifying procedure. That is, there is no need to calculate the waiting time if the retraction verifying procedure is not required.

Figure 7:
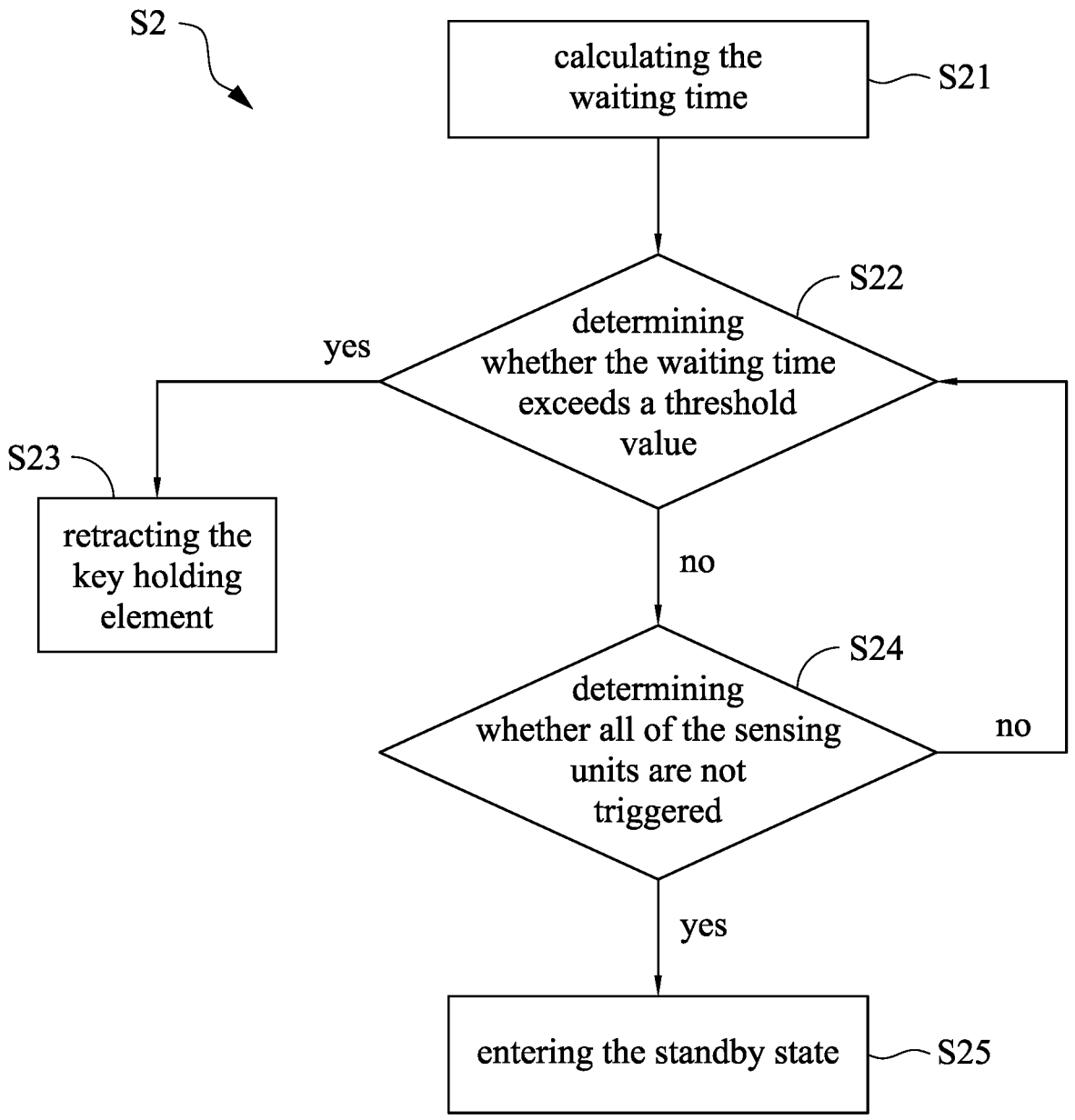
FIG. 7 is a schematic flow chart of a retraction verifying procedure performed by a smart key box according to embodiments of the present disclosure.

Then, as shown in FIG. 7, the smart key box 1 may perform the retraction verifying procedure S2, which includes calculating the waiting time (S21), determining whether the waiting time exceeds a threshold value (S22), retracting the key holding element 12 (S23) if a result is "yes", determining whether all of the sensing units 151-153 are not triggered (S24) if the result is "no", entering the standby state (S25) if a result is "yes", and going back to the step S22 if the result is "no".

Figure 8:
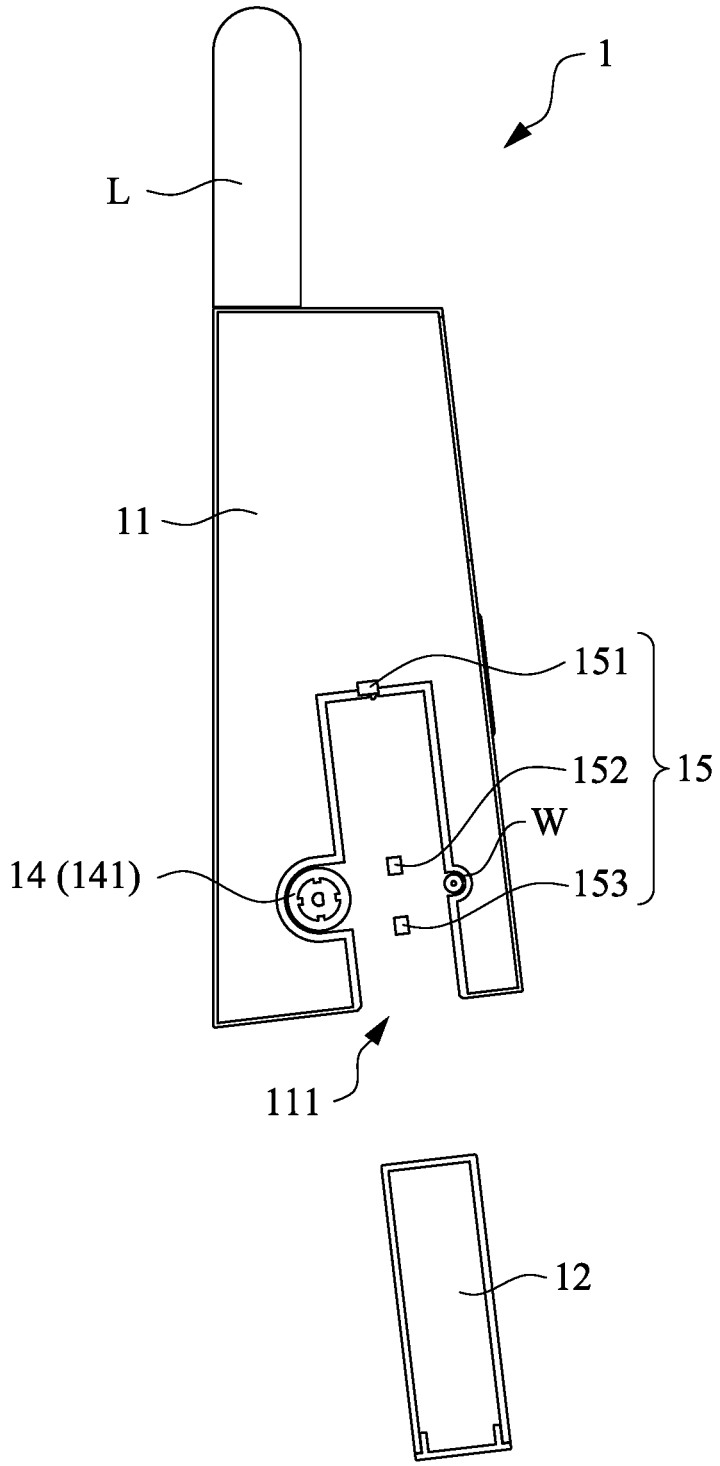
FIG. 8 is a schematic diagram of another state of a smart key box according to embodiments of the present disclosure.

The steps are illustrated below. In the step S21, the control module 13 calculates the waiting time. In the step S22, determining whether the waiting time exceeds the threshold value (e.g., 30 seconds) may be performed by the control module 13. If the result is "yes", it represents a client does not take away the key holding element 12. For safety concerns, in the step S23, the control module 13 controls the power assembly 14 to rotate backward the power wheel 141 so as to retract the key holding element 12. When the key holding element 12 is completely contained in the housing 11, the key holding element 12 contacts the sensing unit 151, such that the sensing unit 151 is triggered. In the step S24, if the waiting time does not exceed the threshold value, it is determined whether all of the sensing units 151-153 are not triggered. When all of the sensing units 151-153 are not triggered, it represents the key holding element 12 has completely left the housing 11, as shown in FIG. 8. That is, the client has taken away the key holding element 12. Thus, the smart key box 1 can enter the standby state. It is noted, the standby state mentioned here is just taken as an example, and the smart key box 1 may be at other operational states according to requirements.

Figure 9:
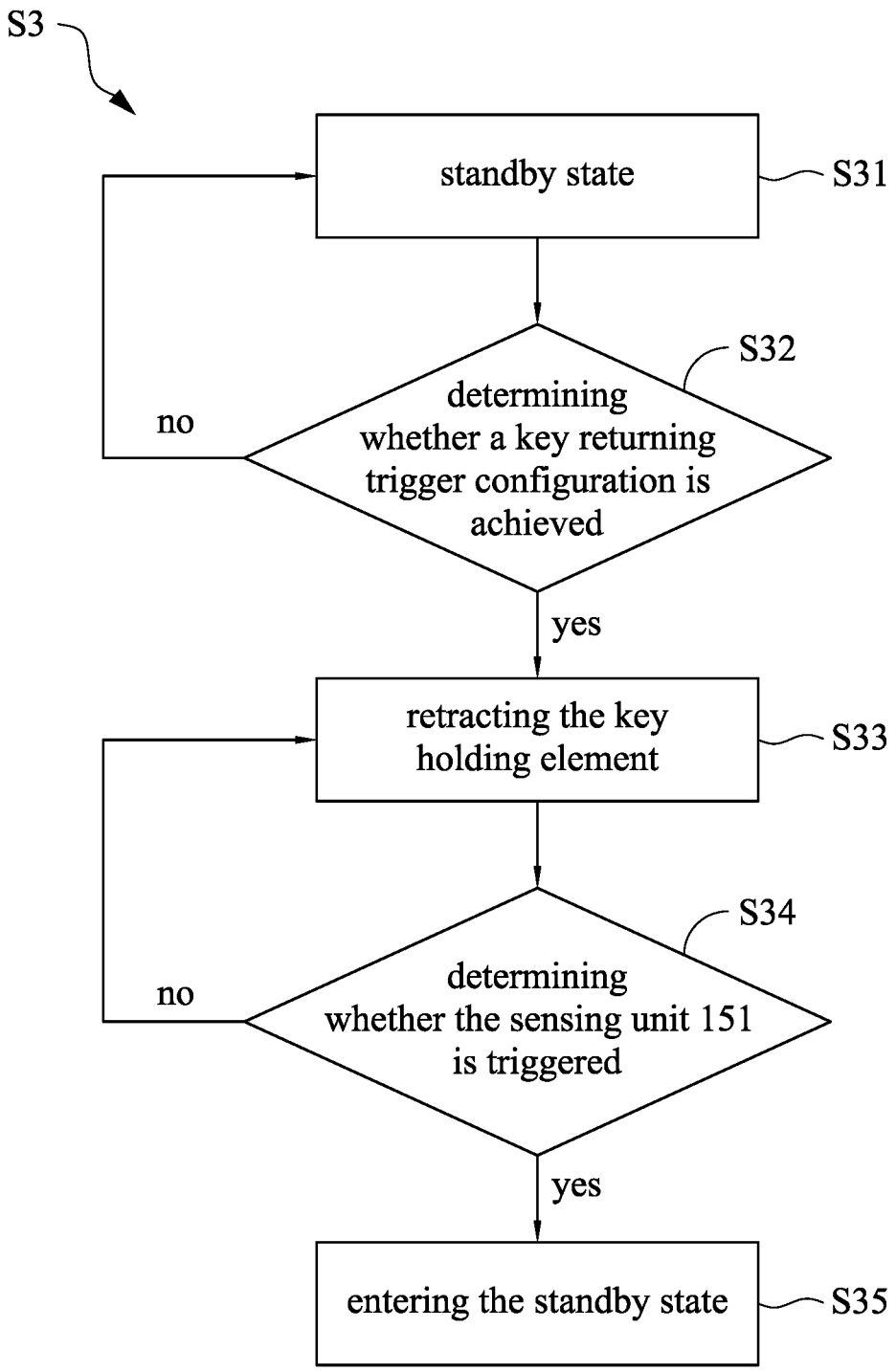
FIG. 9 is a schematic flow chart of a key returning procedure performed by a smart key box according to embodiments of the present disclosure.

Then, as shown in FIG. 9, the smart key box 1 may perform a key returning procedure S3, which includes the standby state (S31), determining whether a key returning trigger configuration is achieved (S32), going back to the step S31 if a result is "no", retracting the key holding element 12 (S33) if the result is "yes", determining whether the sensing unit 151 is triggered (S34), going back to the step S33 if a result is "no", and entering the standby state and sending a notification to a remote control center R (S35) if the result is "yes".

The steps are illustrated below. In the step S31, the sensing unit 153 of the smart key box 1 is enabled. That is, when the user hands the key holding element 12 through the sensing unit 153, the sensing unit 153 transmits a signal to the control module 13. It is noted, the standby state mentioned here is just taken as an example, and the smart key box 1 may be at other operational states according to requirements. In the step S32, when the user puts the key holding element 12 into the housing 11 and hands it through the sensing unit 153, the state as shown in FIG. 6 is achieved. That is, the key holding element 12 only triggers the sensing unit 153, but does not trigger the sensing units 151 and 152, which is the key returning trigger configuration defined in this embodiment. Thus, the step S33 is entered. In the step S33, the control module 13 controls the power assembly 14 to rotate backward the power wheel 141 to retract the key holding element 12. Then, in the step S34, when the key holding element 12 is completely contained in the housing 11, the key holding element 12 contacts the sensing unit 151, such that the sensing unit 151 is triggered. At this time, the smart key box 1 may enter the standby state or other operational states according to requirements.

In this embodiment, although the key obtaining trigger configuration and the key returning trigger configuration both include only triggering the sensing unit 153, in practice, the key obtaining trigger configuration is matched to the key obtaining procedure and the key returning trigger configuration is matched to the key returning procedure. Therefore, the key obtaining trigger configuration and the key returning trigger configuration are distinguished from each other. The above-mentioned distinction may be achieved by a program or a circuit.

It is noted, the procedures of the above various embodiments and the steps thereof are only taken as examples, and are not intended to limit the present disclosure. The implementer can adjust, delete, or add steps and procedures according to requirements.

Figure 10:
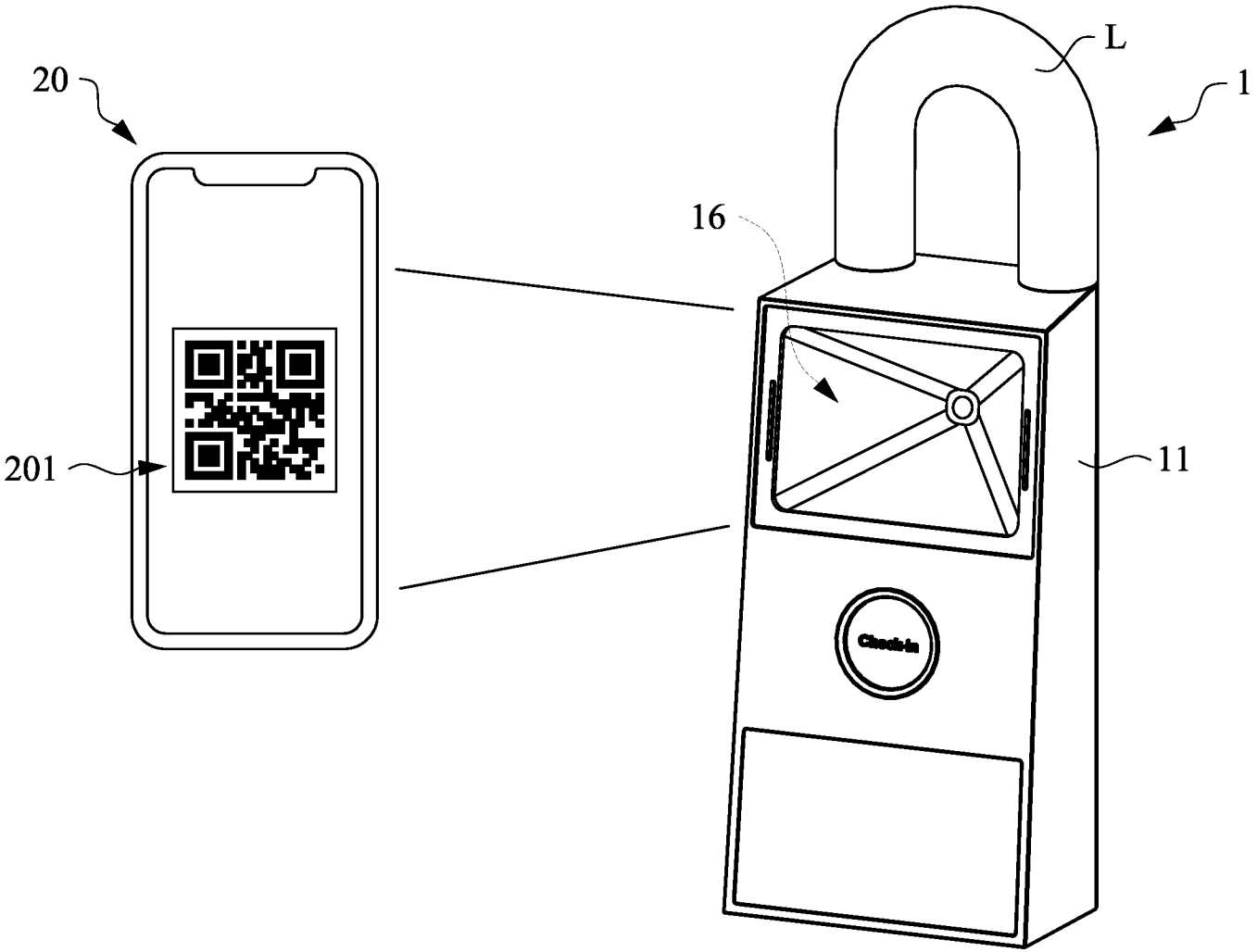
FIG. 10 is a schematic diagram of a smart key box taking a picture of a displayed image of a handheld device according to embodiments of the present disclosure.
Figure 11:
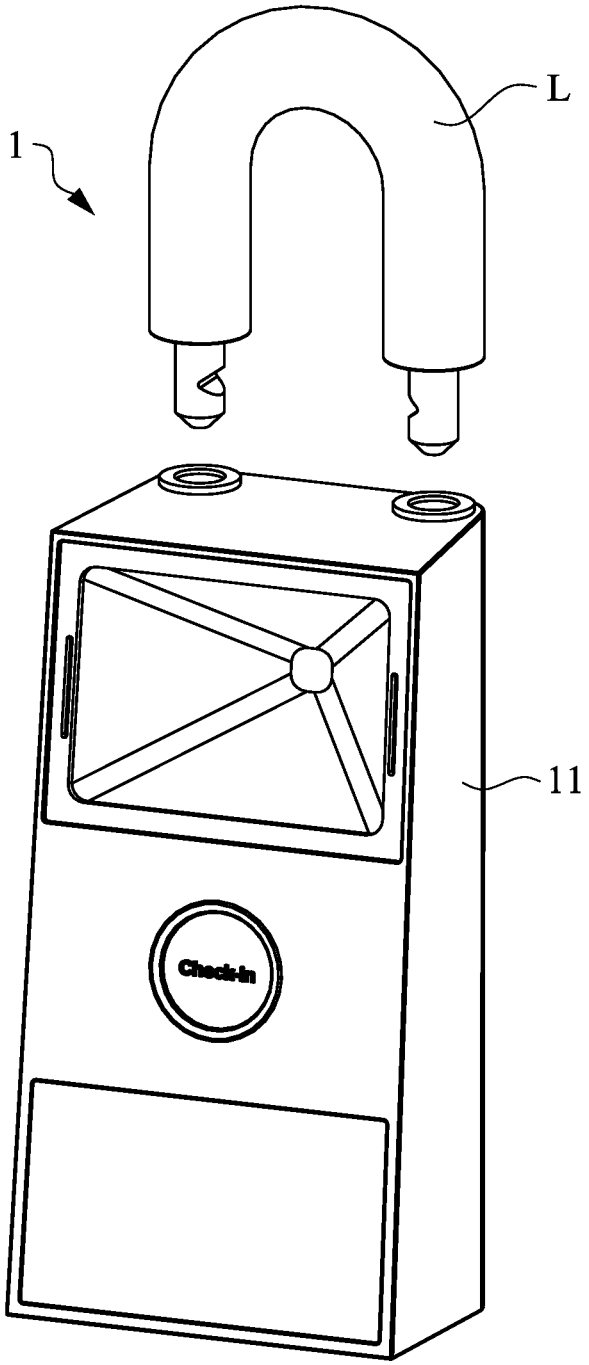
FIG. 11 is a schematic diagram of a smart key box whose locking element is in an unlocked state according to embodiments of the present disclosure.

Referring to FIG. 10, the locking element L of the smart key box 1 is disposed on the housing 11 and can connect with an object to lock the housing 11 to the object. The object is, for example, an object outside the house, such as a mailbox, a fence or a corral. When the agent or staff wants to remove the smart key box 1 from the object, the handheld device 20 of the agent or staff can be placed towards the front side of the housing 11 where the transparent member T or the imaging element of the authentication module 16 is located. The authentication module 16 can take a picture of a displayed image 201 of the handheld device 20 to obtain authentication information. In a normal case, this authentication information is different from that used by a client. Referring to FIG. 11, when the control module 13 and/or the authentication module 16 determine that the authentication information is eligible, the control module 13 controls the locking element L to be in an unlocked state to disengage the housing 11 from the object. The displayed image 201 of the handheld device 20 includes, for example, a two-dimensional barcode. The two-dimensional barcode is, for example, a quick response code (QR-code).

Figure 12:
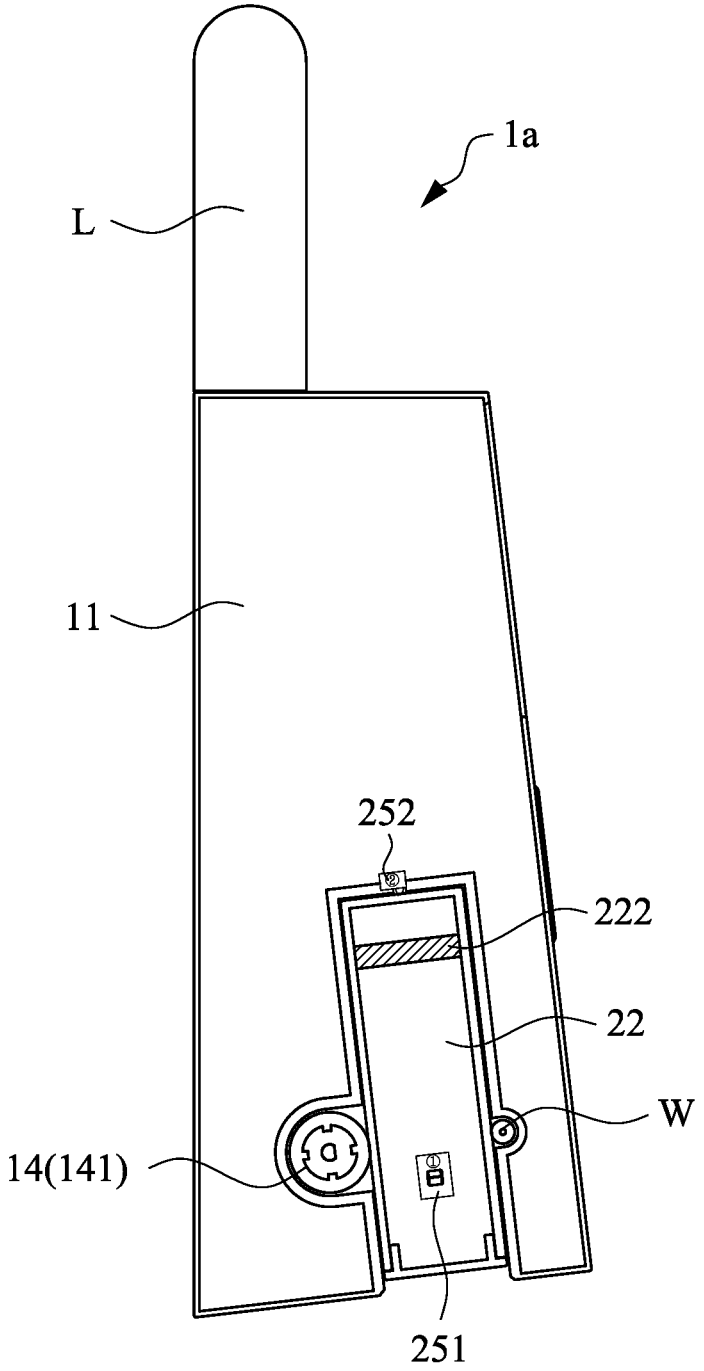
FIG. 12 is a schematic diagram of another smart key box according to embodiments of the present disclosure.
Figure 13:
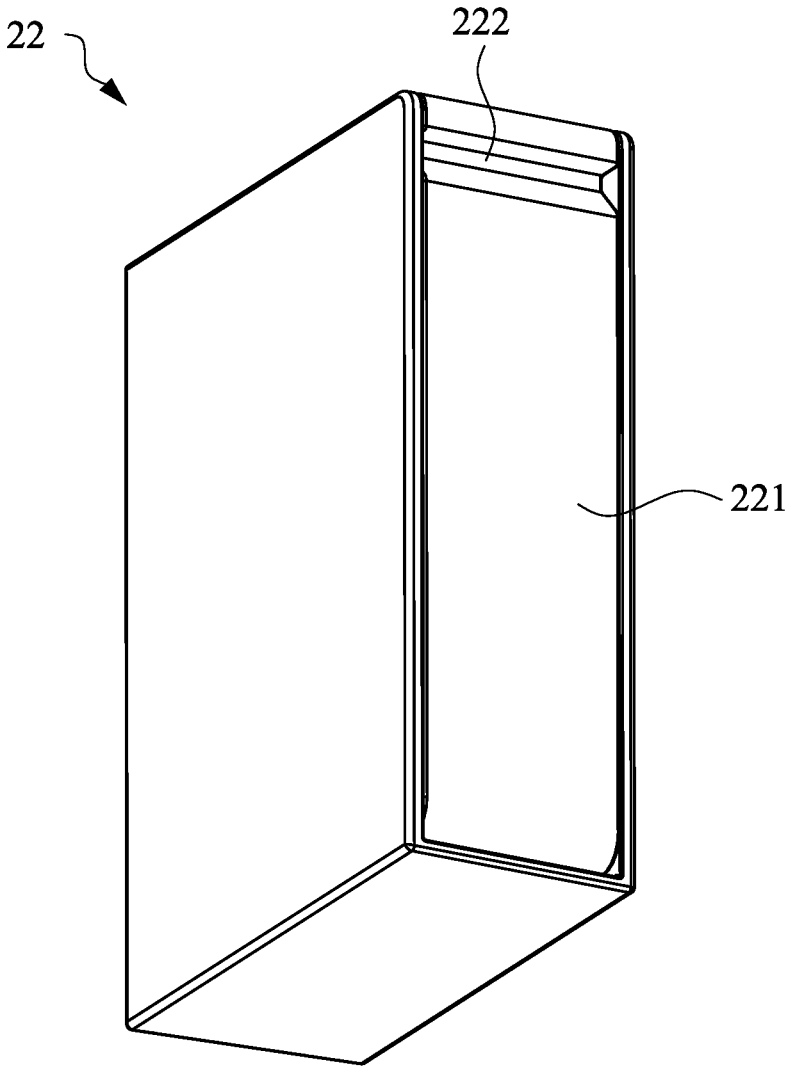
FIG. 13 is a schematic diagram of a key holding element of the smart key box of FIG. 12.
Figure 14:
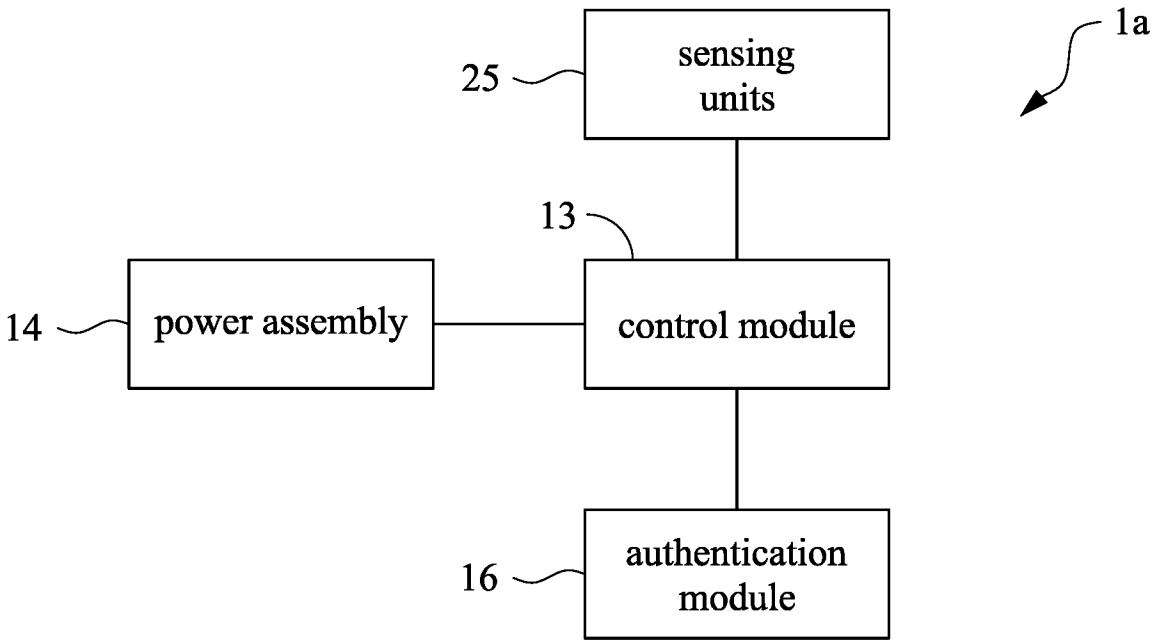
FIG. 14 is a block diagram of the smart key box of FIG. 12.

FIG. 12 is a schematic diagram of another smart key box 1*a* according to embodiments of the present disclosure, FIG. 13 is a schematic diagram of a key holding element 22 of the smart key box 1*a*, and FIG. 14 is a block diagram of the smart key box 1*a*. Comparing FIG. 12 to FIG. 14 with FIG. 2 and FIG. 4, one main difference between the smart key box 1*a* and the smart key box 1 illustrated in the above embodiment is that, the number of the sensing units of the smart key box 1*a* is two, and they are the sensing unit 251 and the sensing unit 252. In this embodiment, the location of the sensing unit 251 can be the same as that of the sensing unit 153, and the location of the sensing unit 252 can be the same as that of the sensing unit 151. In addition, another main difference between the smart key box 1*a* and the smart key box 1 is that, the key holding element 22 of the smart key box 1*a* has a surface 221 and a groove 222. The surface 221 faces the sensing unit 251, and the groove 222 is disposed on the surface 221. When the groove 222 is located over the sensing unit 251, the sensing unit 251 is not triggered. When the groove 222 passes the sensing unit 251 and the surface 221 contacts the sensing unit 251, the sensing unit 251 is triggered by the surface 221.

Figure 15A:
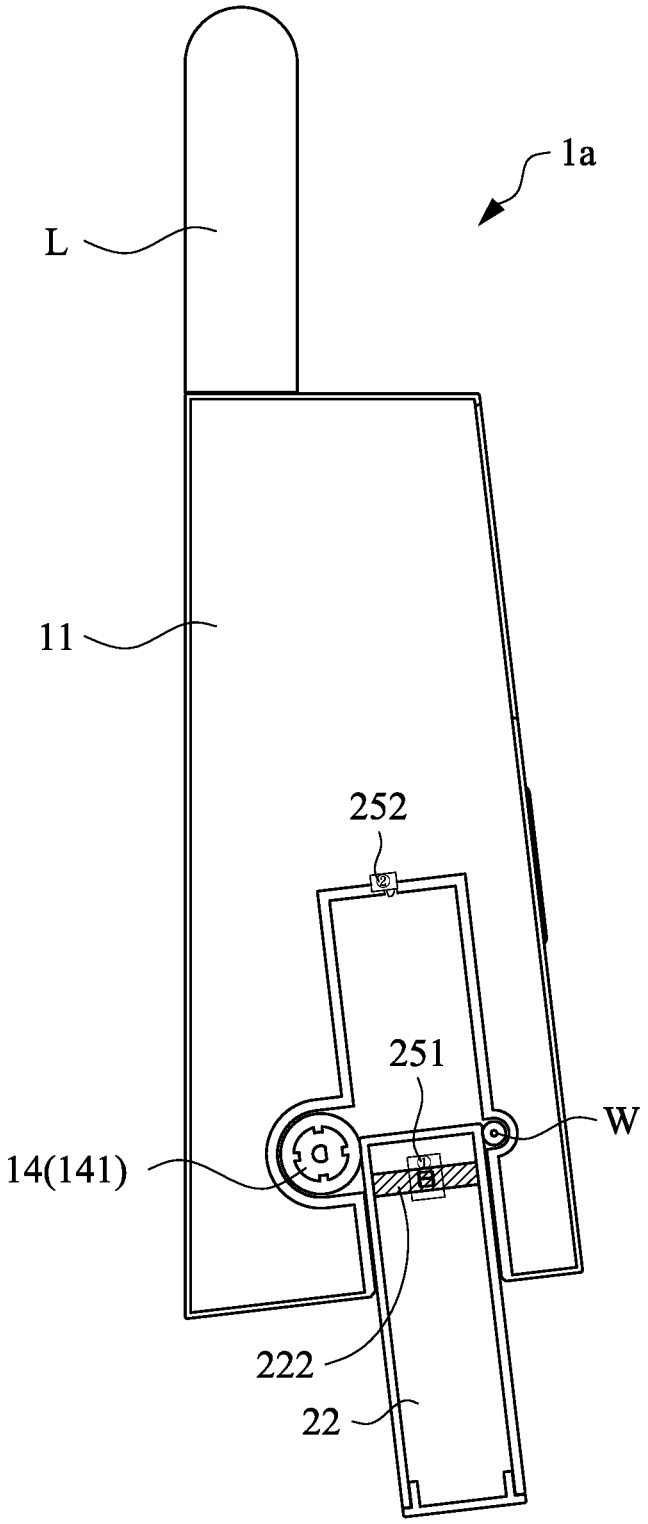
FIG. 15A is a schematic side-view of the smart key box of FIG. 12 in a key obtaining trigger configuration.
Figure 15B:
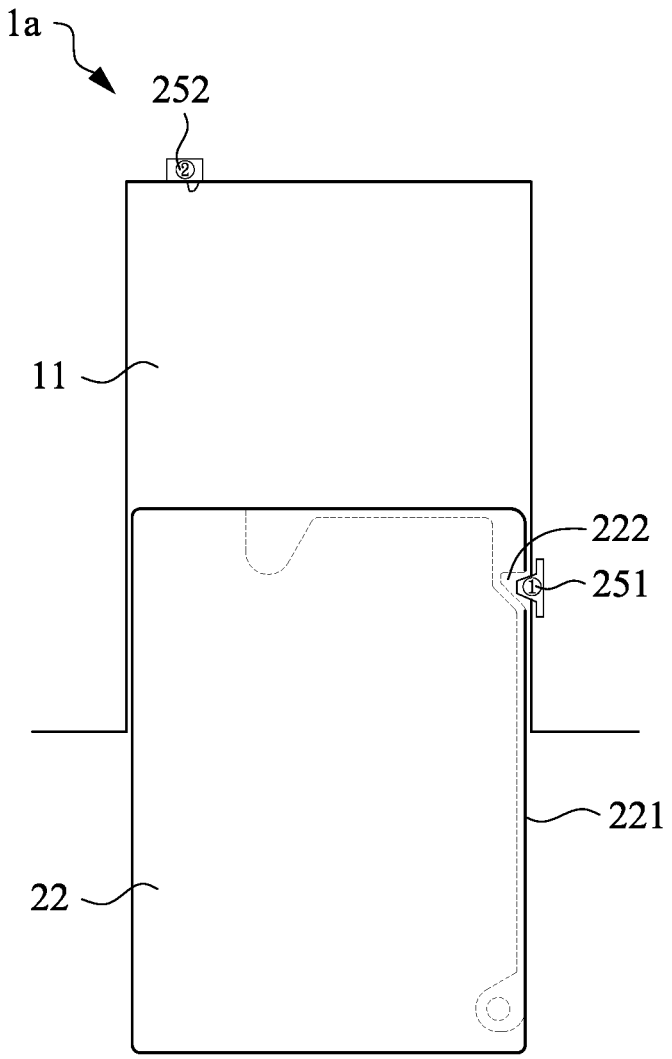
FIG. 15B is a schematic front-view of the smart key box of FIG. 12 in the key obtaining trigger configuration.

FIG. 15A is a schematic side-view of the smart key box 1*a* in a key obtaining trigger configuration, and FIG. 15B is a schematic front-view of the smart key box 1*a* in the key obtaining trigger configuration. When the smart key box 1*a* is in the key obtaining trigger configuration, the groove 222 of the key holding element 22 is aligned with the sensing unit 251, which means the groove 222 is positioned over the sensing unit 251. At this time, the sensing unit 251 is not triggered. From the state as shown in FIG. 12 to the state shown in FIG. 15A belongs to the key obtaining procedure. The illustration of the key obtaining procedure can be referred to FIG. 5 and the related description. When the smart key box 1*a* is in the key obtaining trigger configuration, the power wheel 141 stops rotating and clamps the key holding element 22 with the auxiliary wheel W. Meanwhile, the smart key box 1*a* enters the retraction verifying procedure to determine whether the key holding element 22 is retracted by determining whether the key holding element 22 is taken away by a user.

In the retraction verifying procedure, referring to FIG. 15A and FIG. 15B, when the key holding element 22 is taken away by a user, the groove 222 of the key holding element 22 leaves the sensing unit 251 and then the surface 221 of the key holding element 22 contacts the sensing unit 251 to trigger the sensing unit 251 (ON). Then, when the user continues to take away the key holding element 22, the surface 221 leaves the sensing unit 251, such that the sensing unit 251 is not triggered (OFF). By the above-mentioned consecutive ON and OFF states of the sensing unit 251, it can be determined whether the key holding element 22 completely leaves the housing 11. Moreover, other conditions can be used in combination to determine whether the key holding element 22 completely leaves the housing 11. These conditions, for example, include two ON-OFF cycles experienced by the sensing unit 251 from the state shown in FIG. 12 to that the key holding element 22 completely leaves the housing 11, or the sensing units 251 and 252 both being OFF states when the key holding element 22 completely leaves the housing 11.

Moreover, in the retraction verifying procedure, after the key holding element 22 enters the key obtaining trigger configuration, if the sensing unit 251 is not triggered in a period of time (e.g. 30 seconds), the control module 13 determines that the key holding element 22 is not taken away and can drive the power wheel 141 to retract the key holding element 22. Other portions of the retraction verifying procedure of this embodiment can be referred to FIG. 7 and the related description.

Figure 16A:
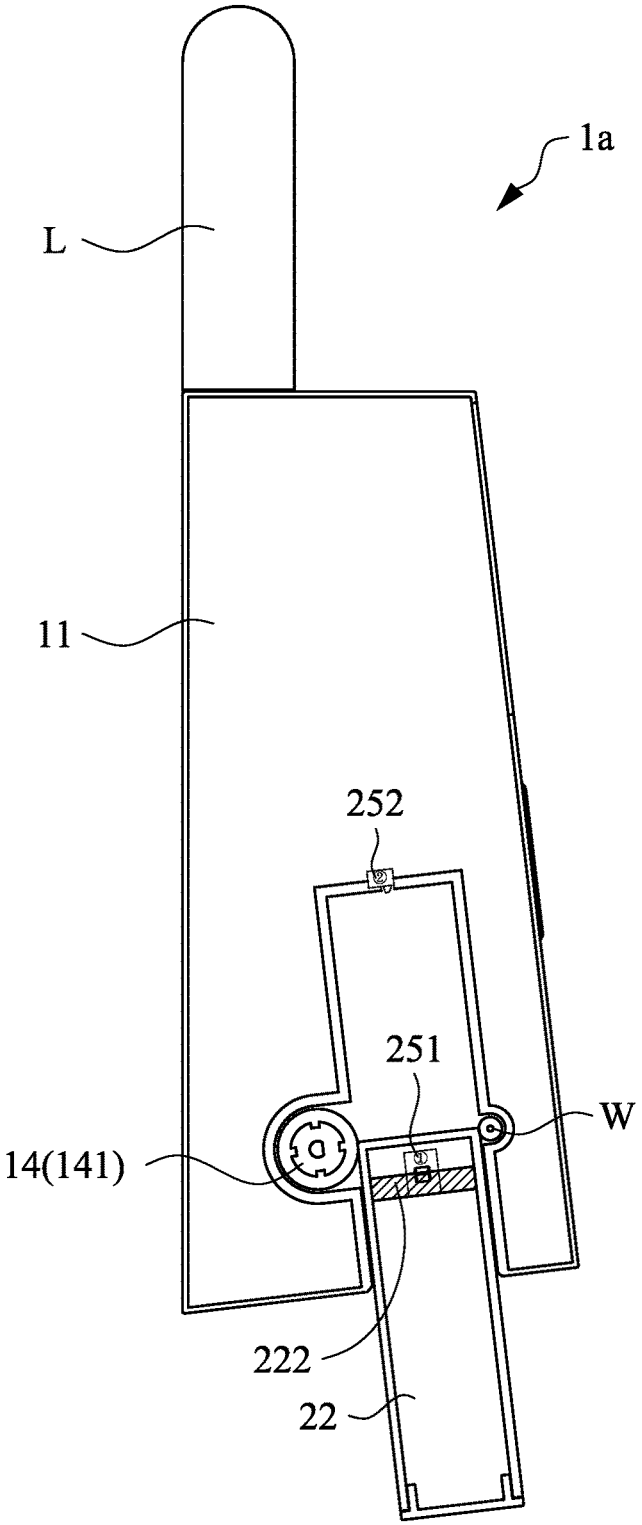
FIG. 16A is a schematic side-view of the smart key box of FIG. 12 in a state when the key holding element is pushed into the housing from outside by a user.
Figure 16B:
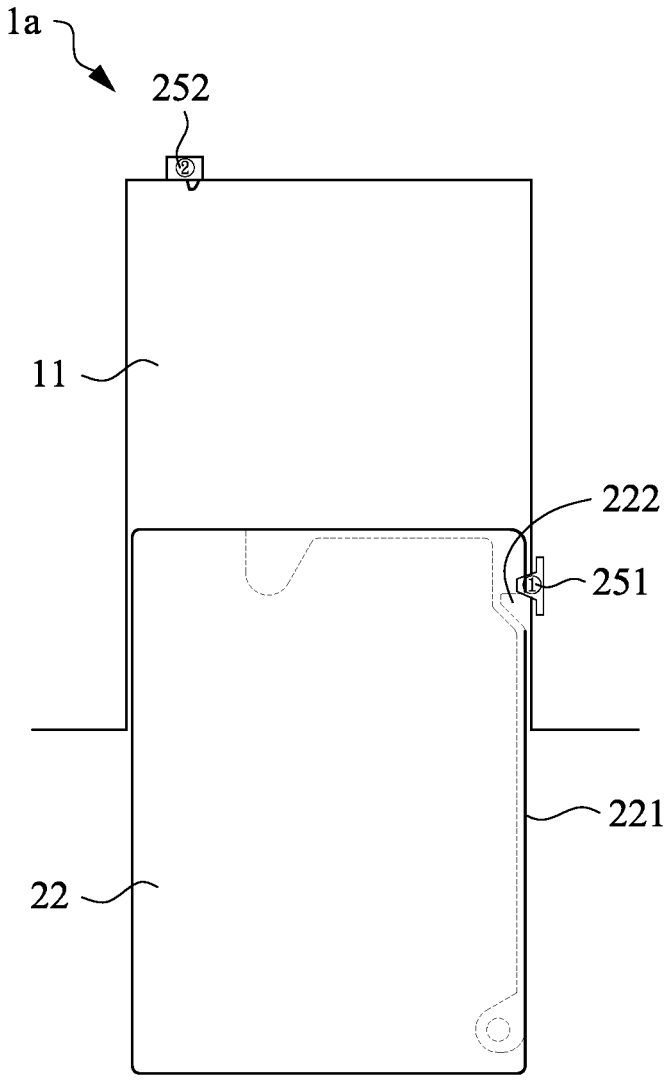
FIG. 16B is a schematic front-view of the smart key box of FIG. 16A.

When the user wants to return the key holding element 22 which has been taken away from the housing 11, the smart key box 1*a* can perform the key returning procedure. FIG. 16A is a schematic side-view of the smart key box 1*a* in a state when the key holding element 22 is pushed into the housing 11 from outside by a user, and FIG. 16B is a schematic front-view of the smart key box 1*a* in the state of FIG. 16A. Referring to FIG. 16A and FIG. 16B, when the key holding element 22 is pushed into the housing 11 from outside, the sensing unit 251 will be first contacted by the surface 221 of the key holding element 22 and is thus triggered. At this time, the key holding element 22 is in the key returning trigger configuration, in which the sensing unit 251 is triggered (ON) and the sensing unit 252 is not triggered (OFF). When the key holding element 22 is in the key returning trigger configuration, the control module 13 can control the power wheel 141 to retract upwards the key holding element 22 until the key holding element 22 triggers the sensing unit 252. Other portions of the key returning procedure of this embodiment can be referred to FIG. 9 and the related description.

As can be seen from the above description, the present disclosure provides a smart key box, which can achieve an authentication operation and automatically push outward the key holding element to allow a user to take the key by a configuration of the key holding element, the power assembly, the sensing units, the authentication module, and the control module. Therefore, in a usage scenario, it is unnecessary for agents to go to the sites, users can get keys via the smart key boxes, thereby improving management efficiency of the agents.

The features of several embodiments are outlined above, so those skilled in the art can better understand the aspects of the present disclosure. Those skilled in the art will appreciate that the present disclosure can be readily utilized as a basis for designing or modifying other processes and structures, thereby achieving the same objectives and/or achieving the same advantages as the embodiments described herein. Those skilled in the art should also understand that these equivalent constructions do not depart from the spirit and scope of the present disclosure, and they can make various changes, substitutions and alteration without departing from the spirit and scope of the present disclosure.

What is claimed is:

1. A smart key box, comprising:

a key holding element configured to hold a key;

a housing configured to contain the key holding element;

a power assembly disposed in the housing and configured to drive the key holding element to leave the housing or enter the housing along an access direction;

a plurality of sensing units disposed in the housing, wherein when the key holding element leaves the housing or enters the housing, the key holding element is configured to trigger at least one of the sensing units;

an authentication module disposed at the housing; and a control module disposed in the housing and electrically connected with the power assembly, the sensing units, and the authentication module, wherein the control module is configured to control the power assembly to operate or not to operate according to the at least one of the sensing units which is triggered.

2. The smart key box of claim 1, wherein the power assembly comprises a power wheel, and the power wheel is disposed in the housing and contacts a side of the key holding element.

3. The smart key box of claim 2, wherein the smart key box further comprises an auxiliary wheel, and the auxiliary wheel is disposed in the housing and contacts another side of the key holding element.

4. The smart key box of claim 2, wherein along the access direction, the power wheel is located between two of the sensing units.

5. The smart key box of claim 1, wherein the sensing units are disposed along the access direction.

6. The smart key box of claim 1, wherein the housing has an opening, the key holding element enters or leaves the housing through the opening, and one of the sensing units is disposed on a side of the housing opposite to the opening.

7. The smart key box of claim 1, wherein the sensing units comprise a mechanical sensing element, an optical sensing element, a capacitive sensing element, an inductive sensing element, an electromagnetic sensing element, or any combination thereof.

8. The smart key box of claim 1, wherein the smart key box performs a key obtaining procedure to push outward the key holding element, and the authentication module is configured to obtain authentication information in the key obtaining procedure.

9. The smart key box of claim 8, wherein the smart key box performs a retraction verifying procedure, and the control module is configured to determine whether the key holding element that has been pushed outward is retracted according to a waiting time.

10. The smart key box of claim 8, wherein the smart key box performs a key returning procedure, and the control module is configured to determine whether the key holding element is returned into the housing according to a key returning trigger configuration of the sensing units.

11. The smart key box of claim 1, further comprising:

a locking element disposed on the housing and configured to connect with an object to lock the housing to the object.

12. The smart key box of claim 11, wherein the authentication module is configured to take a picture of a displayed image of a handheld device to obtain authentication information.

13. The smart key box of claim 12, wherein when the control module and/or the authentication module determine that the authentication information is eligible, the control module controls the locking element to be in an unlocked state to disengage the housing from the object.

14. The smart key box of claim 12, wherein the displayed image comprises a two-dimensional barcode.

15. The smart key box of claim 1, wherein the key holding element comprises a surface and a groove, the surface faces one of the sensing units, the groove is disposed on the surface, and when the key holding element leaves or enters the housing, the groove is configured to pass the one of the sensing units, such that the surface triggers the one of the sensing units.

* * * * *